United States Patent [19]

Way et al.

[11] 3,932,857

[45] Jan. 13, 1976

[54] ALARM SYSTEM SENSING DEVICE

[75] Inventors: Blaine A. Way, Schenectady; William R. Scholtz, Scotia, both of N.Y.

[73] Assignee: Salient Electronics, Inc., Schenectady, N.Y.

[22] Filed: May 23, 1974

[21] Appl. No.: 472,742

Related U.S. Application Data

[63] Continuation-in-part of Ser. No. 159,697, July 6, 1971, abandoned.

[52] U.S. Cl. ..... 340/280; 340/240

[51] Int. Cl.[2] ..... G08B 21/00

[58] Field of Search ..... 340/240, 280

[56] References Cited

UNITED STATES PATENTS

| | | | |
|---|---|---|---|
| 3,192,517 | 6/1965 | Werlin | 340/280 |
| 3,440,636 | 4/1969 | Sliman | 340/280 |
| 3,454,869 | 7/1969 | Strauss | 340/280 |
| 3,753,257 | 8/1973 | Arnold | 340/240 |
| 3,840,870 | 10/1974 | Norrod | 340/280 |
| 3,848,243 | 11/1974 | Schirmer | 340/280 |

*Primary Examiner*—Thomas B. Habecker
*Attorney, Agent, or Firm*—Kane, Dalsimer, Kane, Sullivan & Kurucz

[57] ABSTRACT

An alarm sensor device having two separable portions. One portion is adhesively attachable to the surface of an object. The other section is supplied with a flow of regulated energy. A measurable energy coupling is provided between the two portions and the system is designed so that the act of physical separation of the two sections is detected so as to activate an alarm system. The result is a protective device in the form of an anti-theft alarm system for preventing unauthorized removal of an otherwise movable object from a specific physical location.

5 Claims, 11 Drawing Figures

FIG. 5
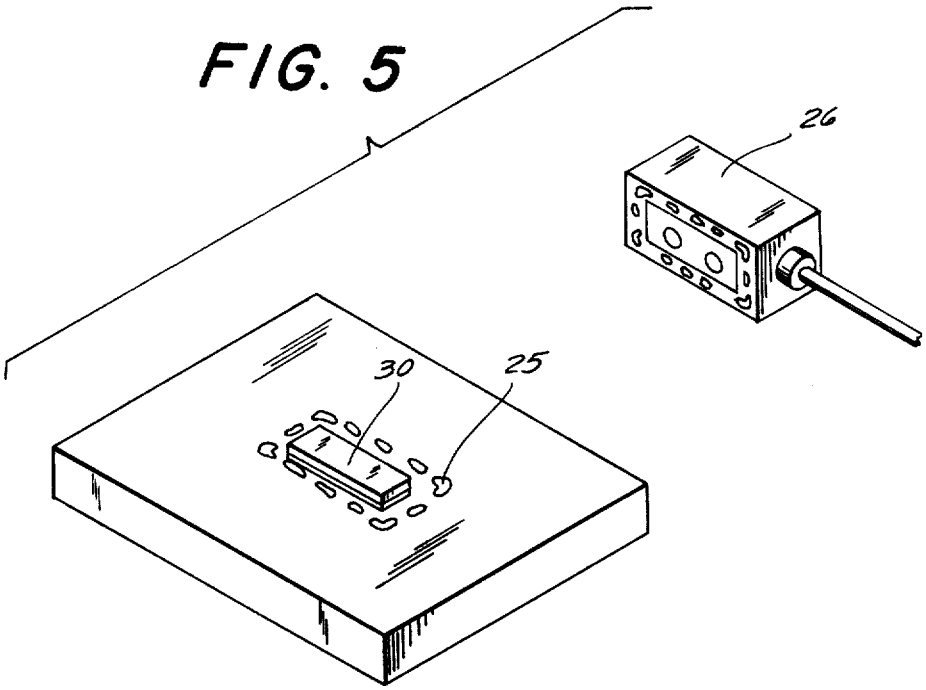
FIG. 6
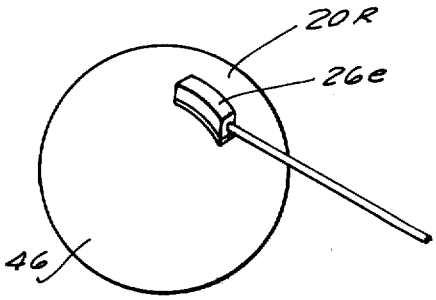
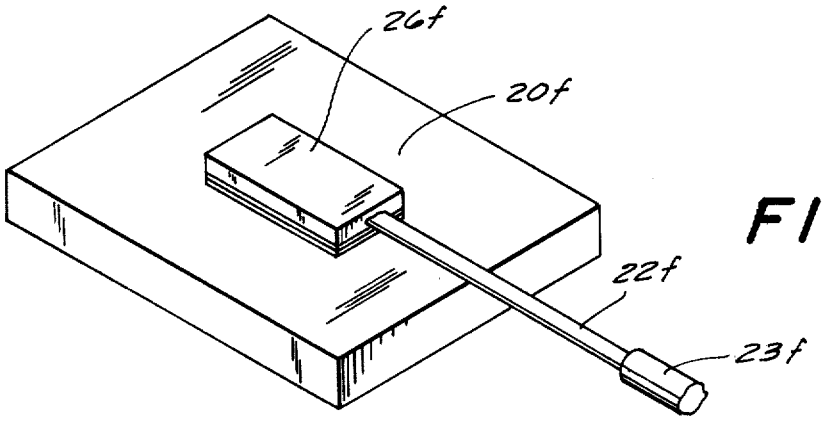
FIG. 7

ALARM SYSTEM SENSING DEVICE

CROSS REFERENCE TO RELATED APPLICATION

This application is a continuation-in-part of application Ser. No. 159,697, filed July 6, 1971 and now abandoned.

BACKGROUND OF THE INVENTION

There are many varieties of burglar alarms, theft alarms and protective alarm systems which serve to protect objects of private property by physically connecting to the object which requires protection, a sensor device which is in turn connected to a remote detecting apparatus by means of energy transmission. The general systems methods rely on the remote detection of an interruption or alteration of an otherwise constant pattern of energy flow which may be electrical, light, magnetic, thermal or fluidic energy.

The means by which a physical connection may be accomplished between such an energy alarm system and an object requiring protection are limited, and usually require that the objects have natural apertures, openings or holes, or that the objects be modified by introducing into them either apertures, appendanges or mechanisms allowing for suitable mechanical interconnection with the alarm system.

There exists many objects such as objects of art and tools which are physically shaped so as to provide no natural means of allowing suitable mechanical attachment to an alarm system. Frequently the physical modification of these type objects are objectionable and often impractical or destructive to the surface of the object.

Although the need is readily apparent, prior art discloses no effective practical method of allowing physical interconnection of an alarm system to an object having an unbroken, smooth or uniform surface structure.

It is also of note that presently available sensing devices for alarm systems are designed in one piece fashion. Consequently, if one is able to remove the entire sensing device from the object being monitored, without distrubing the alarm system, it would be possible to remove the object. Naturally, any structure which makes it difficult to remove the sensing device from the object, in particular structures which provide for alarm activation upon disassembly of the sensing device, would be extremely advantageous and desirable in the art.

SUMMARY OF THE INVENTION

With the above background in mind, it is among the primary objectives of the present invention to provide an improved means of attaching a energy transmission type alarm system to a uniform surface of an object for protective purposes. The present structure permits attachment of the alarm system to the surface of the object in a manner which requires no alteration or modification to the structure of the object itself. Additionally, the present device when interconnected to an alarm system and applied to an object requiring protection provides a system which saves time and cost by virtue of its inherent qualities of ease of installation. Also it should be kept in mind that the present structure resists tampering when it is applied to an object, particularly in locations which are exposed to potential tampering. The device includes detachable components so that removal of one component will cause a reaction in the system causing the alarm system to be activated.

In summary, the alarm system sensing device is compatible with alarm systems providing measured energy forms to external transmission paths. The device includes a housing with a separable portion normally energy coupled to the remainder of the housing and being adhesively attachable to the surface of an object. Energy producing means is associated with the device and is adapted to provide the condition of detectable energy coupling between the separable portion and the remainder of the housing. The remainder of the housing is adapted to be adhesively attached to the surface of the object in a manner mechanically separate from the adhesive attachment of the separable portion. Finally, connection means is on the housing for interconnection of the device to the energy transmission paths of an alarm system. In this manner, when the separable portion is separated from the remainder of the housing and there is a change in the condition of detectable energy coupling, the alarm system will be activated.

It is also contemplated that the device contain a protective component adapted to be adhesively attached to the surface of an object in a configuration whereby the adhesively attached area forms an enclosed and sealed barrier around a centrally located area. In this form means are provided for providing detection means within the centrally located area with the detection means being responsive to the physical presence of an external underlying surface. Control means for causing an alteration of the energy pattern established within an associated alarm system in response to separation of the protective component from the underlying object surface is also included. Finally, connection means is provided for permitting interconnection of the device with the energy transmission paths of an alarm system.

With the above objectives in mind, reference is made to the attached drawings.

BRIEF DESCRIPTION OF THE DRAWINGS

In the drawings:

FIG. 5 is a perspective view thereof depicting the results incurred upon removal of the device from the object;

FIG. 6 is an alternative embodiment of the device of the invention shown in connection with the remainder of an alarm system and mounted on a spherical surface;

FIG. 7 is a perspective view of a further alternative embodiment thereof with the device depicted mounted to a surface and in connection with a fragmentary portion of the remainder of an alarm system;

DESCRIPTION OF THE PREFERRED EMBODIMENTS

Figure 1:
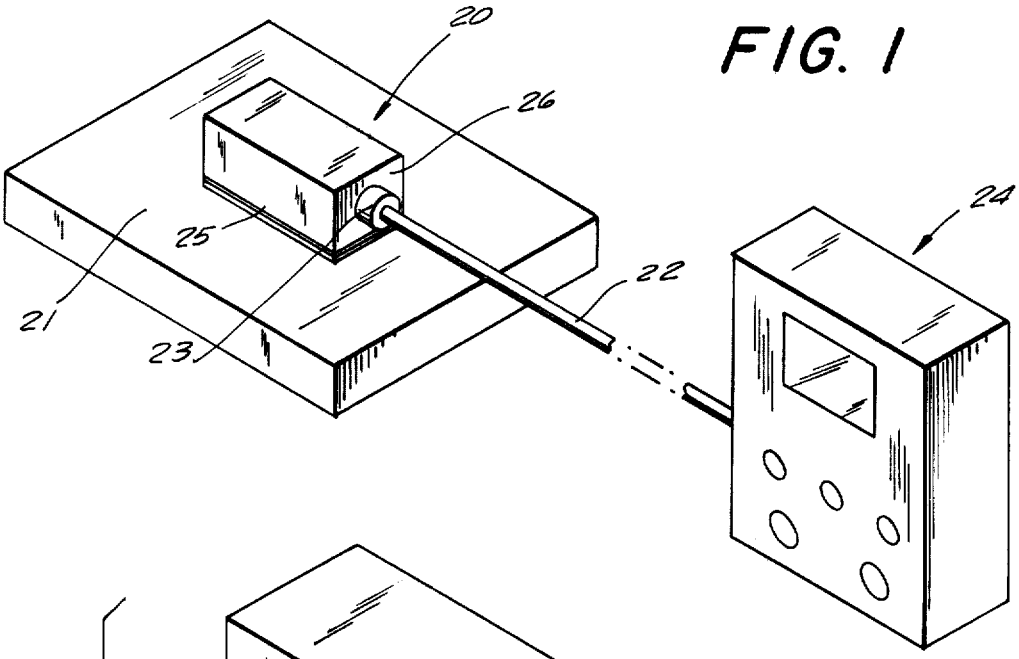
FIG. 1 is a perspective view of the device of the invention as it is used relative to a complete alarm system.
Figure 2:
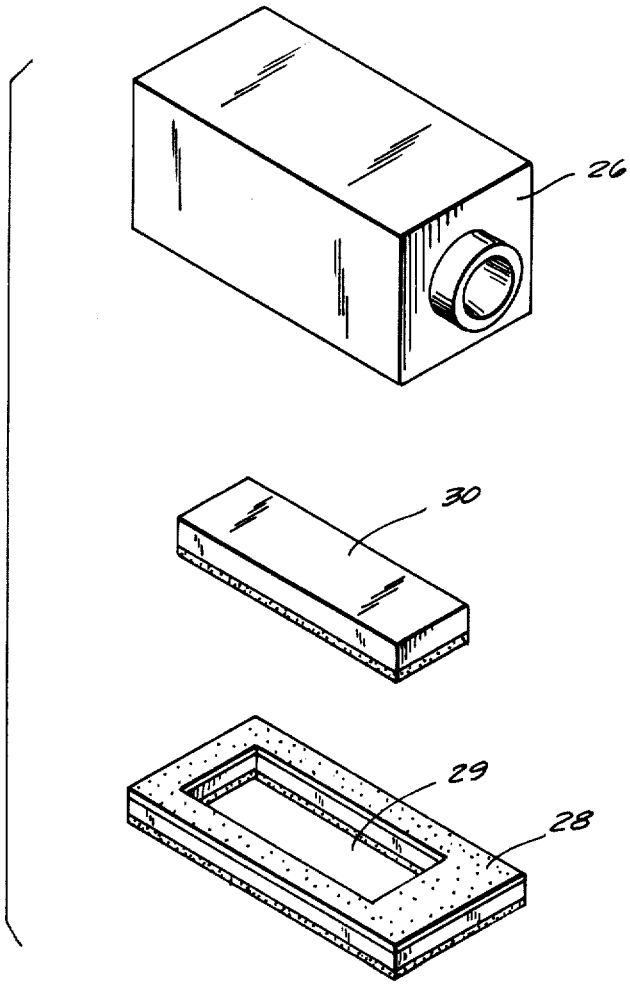
FIG. 2 is an exploded perspective view of the device of the invention.

FIG. 1 depicts alarm sensing device 20 installed adhesively to the flat surface of an object 21. Device 20 is designed for use as part of a complete alarm system where the remaining components are of a conventional and typical design. As shown, an energy transmission path is represented by cable 22. One end of cable 22 is connected to device 20 with connector 23. Energy transmission cable 22 is connected at its other end to an alarm instrument package 24. The alarm instrument package is a system device which provides a source of energy with the energy being regulated precisely and supplied in a constant pattern. Package 24 monitors and measures the energy it transmits to external system components and has the capability of initiating an alarm warning signal upon the occurrence of any unusual alteration of the energy flow pattern.

In operation of device 20, it is securely attachable to object 21 for which protection is desired. Capability is provides for altering the pattern of energy flow within the system upon the occurrence of attempted theft of object 21.

Device 20 provides the means of secure attachment to the surface of object 21 with the use of a pressure sensitive adhesive substance 25 located upon various portions of the undersurface of device 20. The adhesive substance 25 is capable of forming a bond of great strength between portions of device 20 and a surface of object 21.

Figure 3:
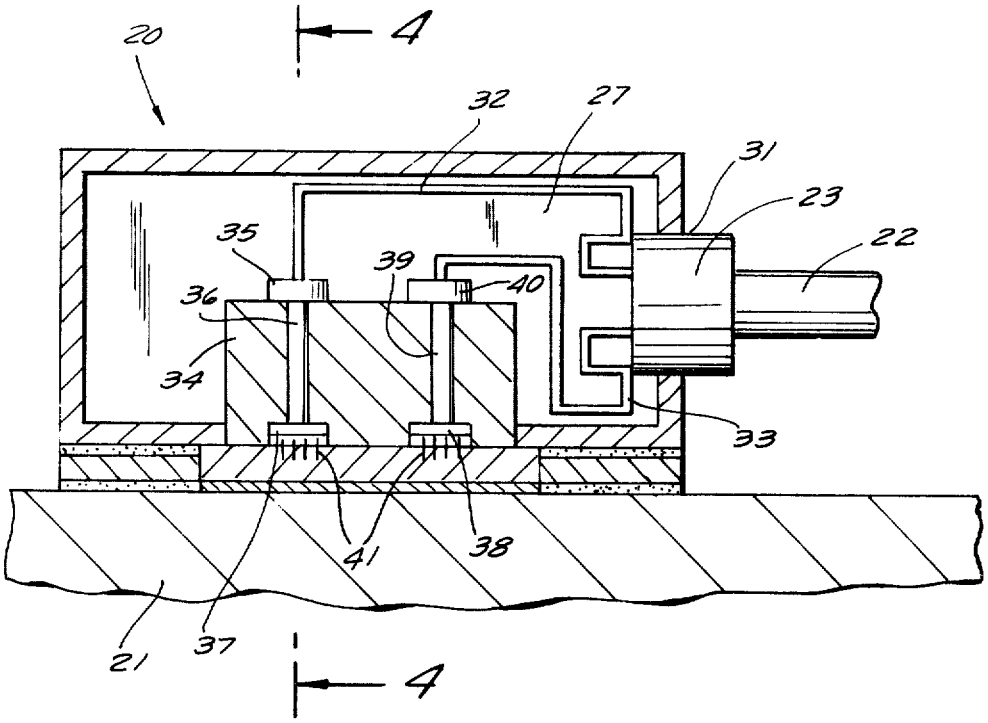
FIG. 3 is a side elevation view thereof with fragments of the remainder of an alarm system and an object to which the device is mounted.
Figure 4:
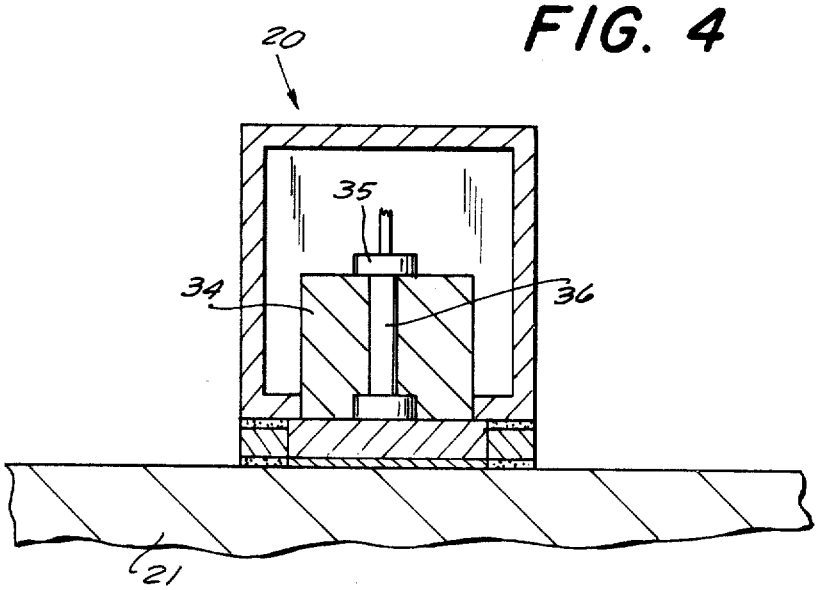
FIG. 4 is a sectional end elevation view thereof.

Having once been installed adhesively, device 20 provides means to alter the pattern of energy flow within the alarm system. The energy alteration occurs upon the subsequent breaking of the adhesive bond previously established. FIGS. 2–5 depict the details of device 20 and its operation when installed on object 21. Device 20 is attached by bonding to object 21 using a pressure sensitive adhesive 25 or other commonly used and well-known bonding agent. Device 20 includes a rectangular shaped housing 26 having a hollow interior so as to provide an inner chamber 27. The undersurface of housing 26 is divided into two portions. An outer peripheral rectangular shaped portion 28 is integrally attached to the remainder of housing 26 and is provided with a rectangular central opening 29. Normally positioned in the rectangular central opening is the inner solid rectangular portion 30. In assembled position on the surface of object 21 as depicted in FIGS. 1, 3 and 4, central portion 30 is in energy communication with adjacent portion 28 and the remainder of housing 21 thereby providing an integral system. Upon forcible removal of object 21 from device 20, the lack of mechanical connection between inner portion 30 and peripheral portion 28 causes them to separate thereby interrupting the energy path therebetween. Consequently, the alteration of the energy force system causes the alarm system to be activated and provide an alarm signal. FIG. 5 depicts the condition upon interruption of the energy path with central portion 30 remaining on object 21 when the remainder of housing 26 has been forcibly detached therefrom by breaking of the bond created by adhesive 25.

At the time of initial installation of device 20 to surface 21, both portions 30 and 28 are bonded to surface of object 21 with portion 28 forming a peripheral sealing rim for portion 30 and thereby prohibiting access thereto without altering the energy force system. When device 20 is forcibly removed from its installed position, the adhesive bond which holds portion 28 to object 21 is broken while the bond between central portion 30 and object 21 remains intact. The dimensions of inner portion 30 and peripheral portion 28 are designed so that they fit snugly with respect to one another and provide the necessary energy transmission paths for proper operation of device 20 within the alarm system when it is intact.

FIGS. 3 and 4 show the interior components of device 20 which are housed in chamber 27 of housing 26. Connector component 23 has a portion extending within chamber 27 and a portion extending outside of chamber 27 passing through an appropriate opening 31 in the side wall of the housing. Conduits 32 and 33 extend through cable 22 and connector 23 into chamber 27. Conduits 32 and 33 are directed in chamber 27 into connection with a proximity sensitive responder mechanism 34. This responder mechanism is within chamber 27 of housing 26 and is mounted in a conventional fashion in alignment with central portion 30 in the undersurface of the housing. As shown, central portion 30 provides a conductive path between conduits 32 and 33 when normally in position in the underside of housing 26 so as to provide a continuous energy transmission path through device 20.

A variety of different proximity sensitive responder mechanisms can be employed as part of the present system and various alternatives are depicted in the embodiment of FIGS. 1–5 and the embodiments as depicted in FIGS. 8–11. The particular choice of mechanism is naturally dependent upon the type of energy which is being utilized with the associated alarm system as well as other readily apparent considerations. The mechanism which is utilized as a proximity sensitive responder mechanism incorporates the ability to establish a specific energy flow relationship between itself and central portion 30 of housing 26. This energy flow relationship remains constant under curcumstances where the actual physical relationship of the central portion 30 and mechanism 34 remains constant. When they become separated, mechanism 34 causes an alteration in the pattern of energy flowing through it.

In the embodiment of FIGS. 1–5, mechanism 34 is of a type which may be employed when the associated alarm system provides energy in the form of pulsating electrical current. Energy transmission paths in this type system are electrical conductors. Pulses of electrical energy flow through points 35 and 36 from conduit 32 to a flat plate 37 which is also an electrical conductor. A second conductive flat plate 38 lies adjacent to plate 37, although not in physical contact with it. The second plate 38 connects through points 39 and 40 to conduit 33 thus providing an energy return path to the alarm system. Central portion 30 is positioned commonly below both plates 37 and 38. Central portion 30 is also an electrically conductive flat plate. Although the three components 37, 38 and 30 do not contact one another physically, they function as a capacitor, and an electrostatic energy field 41 is created at times when energy flows through the alarm system conductors. The actual amount of energy which will be transmitted through the electrostatic field 41 will vary according to the physical distance which separates portion 30 from plates 37 and 38.

Figure 8:
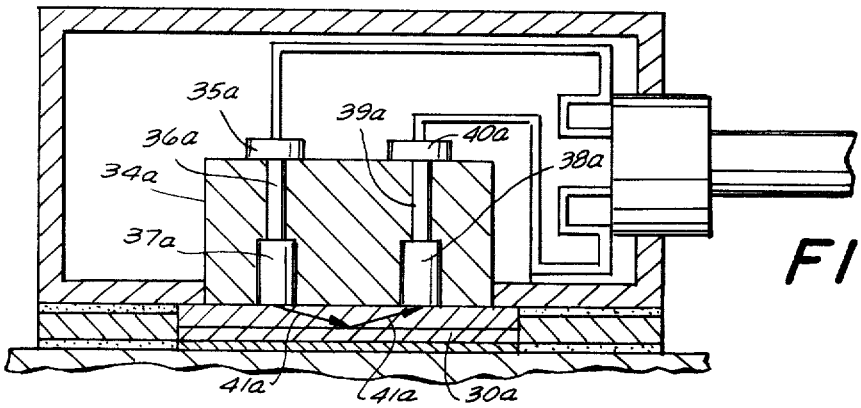
FIGS. 8–11 are side elevation views of alternate embodiments of the device of the invention in connection with the remainder of an alarm system and attached to an object and each embodiment depicting a different type of energy force structure.

FIG. 8 illustrates an alternative mechanism 34a which may be employed when the associated alarm system provides energy in the form of light energy.

Energy transmission paths in such a system are optical conductors. In FIG. 8, light energy flows through points 35*a* and 36*a* to an optical lens 37*a*. Light emission 41*a* from lens 37*a* is focussed upon the surface of portion 30*a*. The surface of portion 30*a* is optically reflective and the light energy 41*a* is reflected so as to be transmitted to a collecting lens 38*a* and hence through the energy transmission path 39*a* and 40*a*. Having once established a constant pattern of energy flow through mechanism 34*a*, the subsequent physical separation of mechanism 34*a* and portion 30*a* will result in a change of energy flow pattern. This change will be sufficient to be detected remotely within the associated alarm system equipment thereby initiating a signal of alarm condition. Parts of this embodiment which are similar to parts of the previously discussed embodiment are identified by the same numerals with the addition of the subscript *a*.

Figure 9:
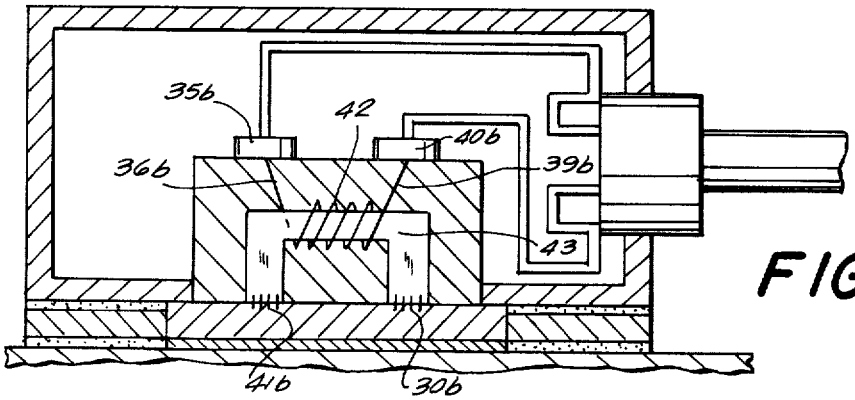

FIG. 9 depicts a further embodiment for the response mechanism with like parts being identified with the same numerals and the addition of the subscript *b*. Mechanism 34*b* is employed when the associated alarm system provides energy in the form of low frequency alternating electrical current. Energy transmission paths which are electrical conductors provide direct connection to the alarm system through points 35*b*, 36*b*, 39*b* and 40*b*. The portion of the conductive path between points 36*b* and 39*b* which is shown as point 42 forms a coil surrounding a portion of the element designated as element 43. Element 43 is a conductor of magnetic energy. In mechanism 34*b*, portion 30*b* is also a conductor of magnetic energy. As alternating electrical energy flows through coil 42, a related field of magnetic energy 41*b* will be created and will flow between element 43 and portion 30*b*. The magnetic field energy 41*b* will vary according to the physical distance between element 43 and portion 30*b* and will in turn have an effect on the alarm system electrical energy which flows through the conductive coil 42.

Figure 10:
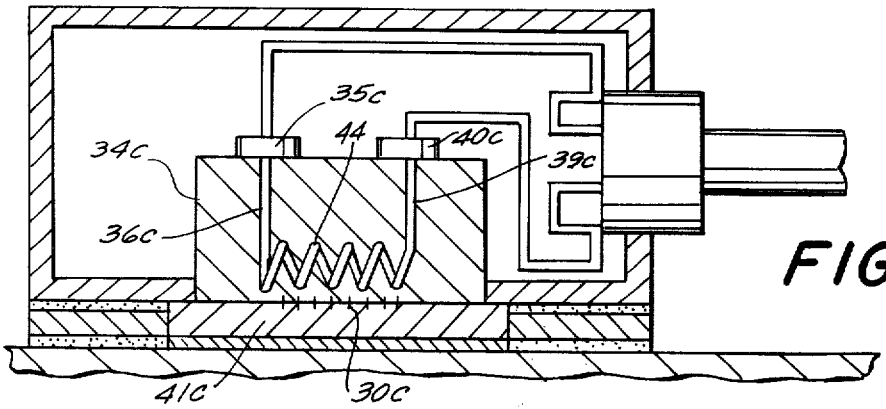

A further embodiment is depicted in FIG. 10 with similar elements to the above discussed embodiments having similar numerals with the addition of the subscript *c*. Mechanism 34*c* is employed when the associated alarm system provides energy in the form of a high frequency alternating current. Energy transmission paths which are electrical conductors provide direct connections to the alarm system through points 35*c*, 36*c*, 39*c* and 40*c*. The portion of the conductive path between points 36*c* and 39*c*, which is identified as element 44 forms a coil which is adjacent to portion 30*c*. Portion 30*c* is an electrical or magnetic conductor. Although no physical contact exists between component portions 44 and 30*c*, the high frequency alternating electrical energy which flows through coil 44 will create an electromagnetic inductive energy field 41*c*, which will be reflected by portion 30*c* back to its source at coil 44. The physical distance between coil 44 and of portion 30*c* will have a measurable effect upon the pattern of electrical energy flowing through the coil 44 and hence through the alarm system.

Figure 11:
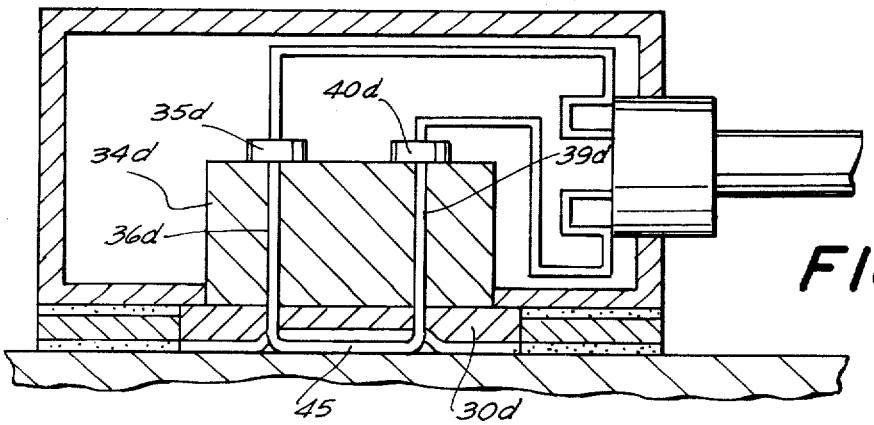

A further embodiment is depicted in FIG. 11 with similar components having similar numerals with the addition of the subscript *d* thereafter. Mechanism 34*d* is designed for employment when the associated alarm system provides energy in the form of fluidic or gaseous pressure. Energy transmission paths in such a system are generally tubular conduits. In mechanism 34*d*, alarm system energy is transmitted directly through points 35*d*, 36*d*, 39*d* and 40*d*. It is necessary in mechanism 34*d* that the physical structure of the energy transmission paths at points 35*d* and 40*d* be attached themselves physically to the interior structure of the housing which encloses them. The mechanical structure of the energy transmission paths including points 36*d*, 45 and 39*d* are specifically designed so as to have less mechanical strength than the relative mechanical strength established by the adhesive bonding which would occur if the component portion 30*d* with its adhesive undercoating were impresseed against and thereby attached to the surface of object 21. The medium of energy transmission at point 36*d* passes from point 35*d* downward through an aperture in component portion 30*d*, along beneath the physical structure of portion 30*d*, for some distance at conduit 45, and thereafter upward through a second aperture in portion 30*d* to continue at point 39*d*, to connection 40*d*. It should be understood that the section of the energy transmission path which is identified as conduit 45 becomes securely and permanently attached to the surface of object 21 requiring protection by virtue of being effectively trapped between portion 30 and the surface of object 21. The separation of component 30*d* results in a stressing and destructive rupture or parting of the energy transmission path at point 36*d*, conduit 45, or point 36*d*. The purposeful impairment of the energy transmission path as described results in an alteration of the preestablished energy constant in the alarm system, and thereby initiates an alarm signal condition.

It should also be noted in connection with the embodiment of FIG. 11, that other energy forms may be employed in a mechanism of this basic structural design, including light energy, thermal energy, magnetic energy and various forms of electrical energy. It should also be recognized as evident, that be means of a wide variety of minor mechanical alterations, modifications can be developed which utilize the component portion 30*d* by incorporating it as an actual section of the energy transmission path.

FIGS. 6 and 7 depict alternative embodiments wherein the above discussed alternative mechanism structures can be employed within housing 26 but wherein the configuration of housing 26 is modified depending upon its use or the surface to which it is applied. In FIG. 6 device 20*e* is identical to the embodiment of FIGS. 1–5 with the exception of the configuration of housing 26*e*. The housing is designed to conform to the curvilinear surface of sphere 46. In this manner, it can be seen that device 20 is adapted for construction in a great variety of shapes and structural designs depending upon the application of its use.

In FIG. 7, device 20*f* is identical with the embodiment of FIGS. 1–5 with the exception of the configuration of major components including housing 26*f*. The purpose is to provide major component parts of the least possible thickness. In order to reduce the overall height of device 20*f*, the associated transmission cable 22*f* is interconnected directly within the structure of device 20*f* itself and the associated connector means 23*f* is located attached to cable 22*f* at a point remote from the main housing in 26*f*. As apparent, the design is structured for use where minimum projection of device 20*f* is acceptable.

Although the invention has been described herein, in several preferred embodiments, those skilled in the art will after understanding the principles of the invention, readily envision various other changes and modifications which might be employed within the scope and spirit of the basic invention and it is therefore intended that the claims appended cover all such changes and modifications.

What is claimed is:

1. An attachment mechanism for use in an alarm system sensing device comprising:

a housing having one surface physically divided into two mechanically separable component parts;

the outer exposed surfaces of the two separable component parts containing chemically adhesive material so as to allow the device to be adhesively attached to the surface of an object in a manner wherein two chemical bonds of attachment occur between the surface of the object and the respective surface areas of each of the two mechanically separable component parts;

one of the two separable component surface parts containing means for mechanical interconnection to the structure of the protective housing in a manner which creates a mechanical strength of attachment which is superior to the relative strength of attachment of the adhesive bonding which occurs between that same separable component part and the surface of an object when it is attached thereto;

the second of the two separable component parts containing means for mechanical interconnection to the structure of the protective housing in a manner which creates a mechanical strength of attachment which is inferior to the relative strength of attachment of the adhesive bonding which occurs between that same separable component part and the surface of an object when it is attached thereto;

the relationship of relative adhesive and mechanical strengths of interconnections between the object surface, the two separable component parts, and the protective housing being such that the forceable detachment of the device from the surface of an object to which it has been adhesively attached will result in the physical displacement of the two separable component parts relative of one part to the other; and the interior of the housing including the separable component parts adapted to receive therein and be attached thereto a variety of secondary component parts, said secondary parts being themselves portions of instrument measuring systems capable of detecting and reacting to changes in the relative physical positions of at least two separable component parts.

2. The invention in accordance with claim 1 wherein the separable component part designated to have an inferior relative bonding strength being physically designated to form adhesively upon the attachment surface of an object, a perimeter boundary protectively enclosing and encompassing a central surface area occupied by the separable component part designated to have a superior relative bonding strength.

3. The invention in accordance with claim 1 wherein the housing and separable component parts are configured so as to be physically adaptable to adhesive attachment upon the surfaces of curved or irregularly shaped objects.

4. The invention in accordance with claim 1 wherein the housing is rectangular in configuration and has a minimum height so as to facilitate the provision of a minimum projection of the device above the surface of the object to which it is applied.

5. The invention in accordance with claim 1 wherein the housing is provided with suitable apertures and connector devices so as to cause the mechanism to be compatible with instrument measuring and detection equipment utilizing physical conduits for the transmission of required energies.

* * * * *